United States Patent [19]

Croy

[11] Patent Number: 4,979,866

[45] Date of Patent: Dec. 25, 1990

[54] WASTE COLLECTING VEHICLES AND PLASTIC WASTE COMPACTORS THEREFOR

[75] Inventor: Maxwell Croy, Wilmette, Ill.

[73] Assignee: Kohlman-Hill, Inc., Chicago, Ill.

[21] Appl. No.: 419,283

[22] Filed: Oct. 10, 1989

[51] Int. Cl.[5] ..... B65F 3/20

[52] U.S. Cl. ..... 414/517; 414/525.6; 414/470; 414/523; 100/100; 100/215; 296/184

[58] Field of Search ..... 100/100, 215, 229 R; 298/10; 296/184; 414/406, 407, 408, 409, 525.55, 470, 501, 512, 517, 525.01, 525.2, 525.6, 523

[56] References Cited

U.S. PATENT DOCUMENTS

| | | | |
|---|---|---|---|
| 3,490,631 | 1/1970 | Smith | 100/100 |
| 3,955,694 | 5/1976 | Herpich | 414/525.6 X |
| 3,964,791 | 6/1976 | Griffis | 414/470 X |
| 4,057,010 | 11/1977 | Smith | 100/100 X |
| 4,096,956 | 6/1978 | Gaskin | 100/215 X |
| 4,113,125 | 9/1978 | Schiller | 414/525.6 X |
| 4,830,436 | 5/1989 | Sockwell | 296/184 X |
| 4,840,531 | 6/1989 | Dinneen | 414/409 |
| 4,877,366 | 10/1989 | De Filippi | 414/525.6 X |

OTHER PUBLICATIONS 2-page brochure entitled, "COMPAC-4—Compact Computerized Compaction," by Kohlman-Hill.

2-page brochure entitled, "HY-DENSE MODEL 500", by Environmental Equipment Corporation.

2-page brochure entitled, "The Right Model for the Right Job—The Model 1830-2000", by Auto-Pak Waste Compaction Systems.

2-page brochure entitled, "Multi-Pak Model MP 12," by Multi-Pak Sales Corporation.

6-page brochure describing the 11172/AUT System by Auto-Pak Waste Compaction Systems.

2-page brochure entitled, "SAC:Features and Benefits".

2-pages of Sketches of a Compactor Made by Jurek Manufacturing for Waste Management Corporation.

*Primary Examiner*—Robert J. Spar

*Assistant Examiner*—Craig Slavin

*Attorney, Agent, or Firm*—Fitch, Even, Tabin & Flannery

[57] ABSTRACT

A vehicle is provided with a plurality of refuse collection units one of which is compactor unit mounted transversely across the vehicle. The vehicular mounted waste compactor includes a hollow body having opposed open ends each having an intake opening for receiving waste to be compacted. Divider walls within the interior the hollow body divide the interior into a receiving chamber and a compaction chamber with a passageway communicating therebetween. To reduce the length of compaction stroke and the space needed for the ram, it includes a sliding cover wall movable back and forth for selectively closing and opening the passageway. One end of the hollow body has a door against which the ram compresses the waste material. When opened, the compressed material is discharged in the direction of ram travel. To reduce the stroke needed for compaction and the space needed for hydraulic cylinders to move the ram, the cylinders are mounted diagonally to each other and to the direction of ram travel.

22 Claims, 6 Drawing Sheets

WASTE COLLECTING VEHICLES AND PLASTIC WASTE COMPACTORS THEREFOR

BACKGROUND OF THE INVENTION

1. Field of the Invention

This invention relates to refuse collection compactors for use on refuse or recycling vehicles and to refuse collection compactors used to compact plastic containers or the like while on a refuse recycling vehicle.

2. Description of the Related Art

More and more communities are beginning to recycle plastic and particularly plastic containers because landfill sites are being filled and because the plastic is not readily biodegradable and lasts in these landfills for many years. Such communities are having their refuse segregated at the pick-up site into paper, glass and plastic categories; and have refuse trucks with three or more segregated units or compartments each assigned to hold a specific category of refuse. The plastic compartment or unit is providing a problem in that it readily fills with hollow plastic containers, often plastic blow-molded containers for quarts, half-gallons, or gallons of liquid such as milk, etc. It has been recognized that a compaction of the plastic containers could reduce volume needed for plastic by a factor of 6 to 1 or even 10 to 1, thus allowing trucks to pick up more refuse before unloading.

An attempt to provide a commercially acceptable plastic container compactor mounted on a refuse truck employed a pair of rams in a compaction chamber, each ram being mounted for movement at right angles to the other. A plastic bottle is inserted into the compaction chamber, and a first ram crushes the bottle. The second ram thereafter pushes the crushed bottle into a discharge chamber and may apply additional compaction thereto during the process. However, only a single plastic bottle can be accommodated at any one time and such is unsatisfactory for waste collection situations in that it is too time consuming to wait for a single container to be compacted. A typical residence may produce a half dozen plastic containers or more during a collection cycle, and larger waste collection customers such as hospitals, restaurants and commercial establishments produce plastic containers in much greater quantities. Hence, it is impractical to process such plastic containers, one item at a time.

The space on a recycling truck for such materials is quite limited. Usually the truck beds are only eight feet in width; and while considerably longer in length, the length is usually divided into a plurality of separate compartments for containers for glass, paper, and plastic. The usual space allotted for a compactor for one compartment will be typical in the range of three to four feet. The height of the compartment having the compactor is also limited and is usually about three to four feet in height above the truck bed. Thus, the space available for an onboard compactor unit and the storage volume for the compacted material is relatively small. Further, it is desirable that the incoming materials being put into the compactor through access openings on either side of the truck so that the driver need not go around the truck irrespective of which side of the truck the driver is on. The access from either side further reduces the actual volume left for the compacting apparatus and for holding compacted materials. The use of a pair of rams mounted at right angles to one another uses a considerable volume within the container leaving a minimal volume for the compaction chamber in which the compacted materials are stored.

In a compactor unit having a ram, the ram and its fluid actuating cylinder or cylinders occupy a considerable volume and this is not problem where the unit is stationary and/or has a large space in which to be situated and can have a large (often separable) receiving chamber for storing the compacted refuse. The problems facing a design for such refuse vehicles is that there is a very limited volume space on a truck for each collection unit; and in particular, for the plastic compactor unit because of the space needed for the operating strokes of the ram and its operating mechanism. In the eight foot truck bed width, for example, it is desirable to have a receiving chamber capacity of at least five feet and to have the ram penetrate into the compaction chamber at least six inches (preferably seven inches or more) so that the compacted material will not spring back into the receiving opening in front of the ram when the ram returns to its retracted position. Preferably, the opening to receive a quantity of plastic in front of the ram space is relatively large, for instance, twenty inches or larger. This leaves only about eighteen inches left in the eight feet width for the ram and its operating cylinder.

Preferably, the ram ought to have a stroke of over twenty-six inches to move across the opening and at least six inches into the receiving chamber. This is a somewhat paradoxical requirement of having only eighteen inches for a ram and its cylinders and yet expecting a twenty-seven inch or more stroke. It is not only a length problem to be solved, but is also a volume problem in that it is preferred that the person throw in the plastic containers from either side of the vehicle in over the tops of the receiving chamber and over the top of the compaction chamber in which is positioned the ram apparatus, from each side of the truck. Thus, there must be a volume used in the unit as an inlet chute preferably in the upper portion of the unit for directing the containers to a position in front of the ram. Typical, loading heights are two feet to four feet above the truck bed. By way of example only, the volume occupied by the ram apparatus in a compactor having an eight-foot width, a height of three feet and a depth of three feet should be preferably about 0.25 cubic yard or less with a receiving container capacity of 1.00 cubic yard. In larger units, having a four-foot height and a depth of four feet with an eight foot across the truck width, the ram apparatus may be about 0.37 cubic yard and the receiving container may have a 2.00 cubic yard capacity with a longer ram stroke of thirty-nine inches or longer. Manifestly, the dimensions are by way of example to indicate the severity of the engineering problems to accommodate all of these requirements in a very small space. By way of example, the forces desired are quite large for compaction with a preferred ram face pressure in the range of 1,600 to 2,200 psi to achieve packing forces in the range of 22,600 to 55,400 pounds. These forces are typical and representative and may be changed, as desired, to meet different criteria.

In addition to receiving compacted containers, there is also the problems of discharging and segregating the compacted plastic. Herein, there is an easily open door discharge which allows the containers to be dumped onto a segregation area or conveyor so that the plastic may be segregated as to type. If one shreds the plastic while on board the truck, it is more difficult to segregate and classify as to material type. It appears that typical plastic refuse may be as follows:

| | |
|---|---|
| LDPE: Garbage Bags, Bread Wrappers | 40% |
| HDPE: Milk and Detergent Bottles | 28% |
| Polypropylene: Lids and Heavy Wrappers | 10% |
| Polystyrene: "Clamshells" | 10% |
| PET: Soft Drink Containers | 7% |
| PVC: Cooking Oil Containers, Food Wrappers | 4% |

The present invention will dump such a typical refuse on a sorting area or a conveyor for further segregation of each of the above plastic materials.

Because the compactor is mounted on a truck, it needs to be small but also it should be relatively lightweight to travel over city streets and country roads. By way of example, the above-described compactors of this invention weigh between 1,820 and 2,480 pounds. Compactors are also subjected to abuse and they should be relatively trouble-free. Safety in loading, compacting and discharging of the compacted material are also criteria to a successful traveling, vehicle compactor on a recycling truck. Also, discharge of the compacted material from the compaction chamber should be a quick and easy task, preferably using the compaction ram to push the compacted material from the compaction chamber and/or the compactor should be easily titled for gravity and sliding unloading.

SUMMARY OF THE INVENTION

It is an object according to the present invention to provide a waste compactor which is compact in size and space efficient with relatively long ram strokes and large storage capacity and which is mountable a vehicle to be driven in residential and in confined areas.

Another object according to the present invention is to provide a waste compactor which is mountable on a vehicle, and which has intake openings at opposed ends thereof so as to render the compactor suitable for curb side recycling.

A further object according to the present invention is to provide a waste compactor which provides a discharge opening through which compacted waste can be ejected with a compacting ram.

These and other objects according to the present invention which will become apparent from studying the appended description and drawings.

The present invention provides a refuse vehicle compactor which has a small compaction chamber with a ram and its fluid actuators taking up a small length across the truck bed, e.g., eighteen inches and having a large opening, e.g., twenty-two inches or more to receive plastic containers. A large ram stroke is provided to push containers from the opening and into the receiving chamber by a sufficient amount, e.g., seven inches. This long stroke, e.g., of twenty-seven inches or longer, is achieved by having the ram formed of two overlapping parts with one part being a sliding cover plate which is pulled by the ram during its compaction travel to a position to cover the opening in front of the ram and by crossed actuating cylinders which are diagonally mounted behind the ram and pivotally connected to the ram. As the ram extends the cylinders pivot to provide a greater travel length than they would if they were mounted in the axial direction of ram travel. The preferred embodiment has a pair of inlet openings at opposite ends of the unit each for receiving plastic containers thrown into the compactor. Preferably, inclined plates direct the containers into the opening in front of the ram. The operator may control a ram power switch to cause the ram to slide across the opening and to push the containers into the receiving chamber. Preferably, both the receiving chamber and the ram and cylinders are located in a lower portion of the compactor body beneath inclined plates across which the containers travel to the opening in front of the ram. A door is provided on the compactor unit to be opened to discharge the compacted plastic in the receiving chamber. The door is preferably opened at a safe, remote distance from the door by a door actuator and locking means. Herein, the compacted load is discharged through a side hinged door located beneath one of the unit's inlet openings with ram reciprocation and/or tilting of the unit.

BRIEF DESCRIPTION OF THE DRAWINGS

In the drawings, wherein like elements are referenced alike.

DETAILED DESCRIPTION OF THE PREFERRED EMBODIMENTS

Figure 1:
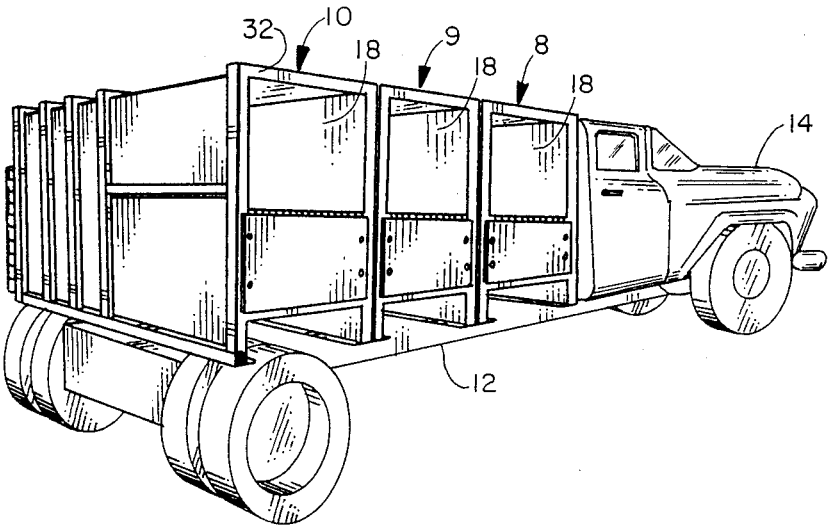
FIG. 1 is a perspective view of a vehicle upon which are mounted waste compactors illustrating aspects according to the present invention.
Figure 2:
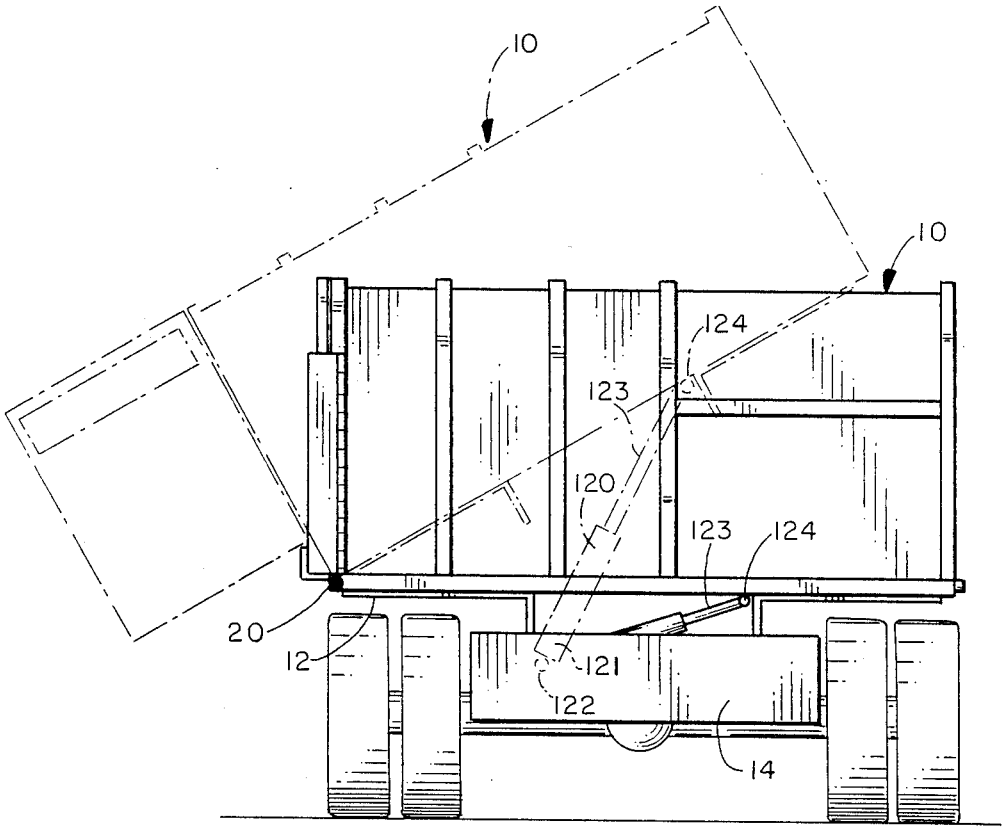
FIG. 2 is a rear elevational view of the vehicle of FIG. 1 showing a first mode of discharge of compacted waste.

Referring now to the drawings, and initially to FIGS. 1 and 2, a plurality of waste units, e.g., three waste units 8, 9 and 10 are mounted on the bed 12 of a truck vehicle 14. Typically, the unit 8 may receive paper and the unit 9 receives glass, and the unit 10 having a compactor, receives plastic. First ends of the units are visible in the foreground of FIG. 1 and each include intake openings 18 through which waste is admitted into the respective unit 8, 9 or 10. As can be seen in FIG. 1, the units have a width extending across the width of the truck body, which is substantially greater than their end dimensions, particularly the end dimension extending along the longitudinal axis of the truck bed. Accordingly, a plurality of units 8, 9 and 10 can be mounted side-by-side on a conventional truck body, the resulting combination easily negotiating residential streets and alleys as well as relatively narrow driveways and passageways such as those frequently encountered in high rise areas and in the plant services portions of shopping malls and the like. By way of example only, the truck bed may be eight feet in width and about twelve feet in length leaving only four feet or less for each unit. In height, the units are limited because the persons inputing the waste do not want to reach too far over their heads. Typically, the units are about 36 to 50 inches in height. Manifestly, these dimensions may vary considerably and are given only by way of example.

Referring briefly to FIG. 2, the compacted plastic may be removed for segregation from the compactor through a discharge door at one end thereof, which can be opened, for example, in the manner illustrated in phantom in FIG. 2, to allow a gravity discharge of the contents of the compactor. FIG. 2 schematically illustrates a hydraulic piston elevating one end 32 of the waste compactor relative to the other end 30 of the compactor having the discharge door.

In the embodiment of the invention shown in FIG. 2, the compactor unit is connected by means such as a pivot shaft 20 to the truck bed 12 and an actuator means in the form of a hydraulic cylinder below the unit has one end 121 pivotally connected to the truck chassis at 122 and piston rod end 123 connected at 174 to the underside of the compactor unit 10. Extension of the piston rod lifts the container about the shaft 20 to the dotted line discharge position.

Figure 3:
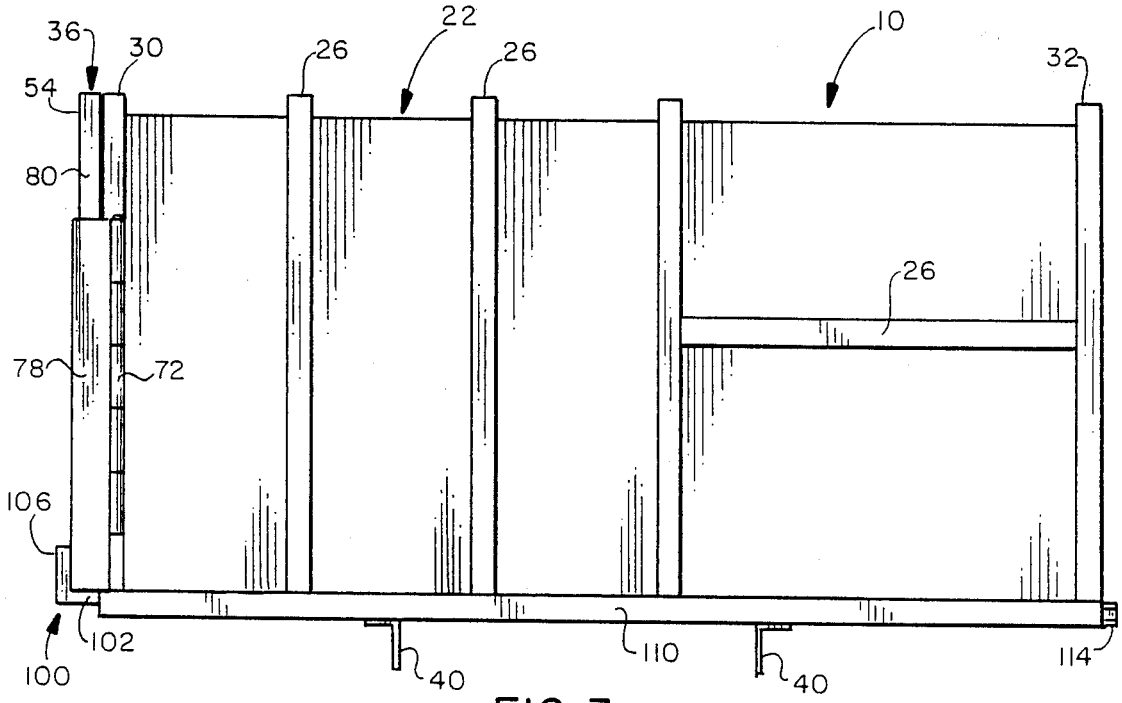
FIG. 3 is an elevational view of the rear side of the compactor of the above figures, taken on an enlarged scale.

Referring additionally to FIG. 3, the waste compactor 10 includes a hollow body 22 comprising sheet metal wall portions 24 stiffened by external girder or bracing members 26. The body 22 has first and second ends 30, 32 and according to one principle of the present invention, the body is characterized by an intake opening at each end, thereby facilitating waste collection from either curb side of a street.

According to another important feature of the present invention, the first end 30 of body 22 is open, the body 22 appears as a box-shaped or rectangular hollow tube, preferably of rectangular cross-section. The open end 30 of body 22 is partially enclosed by a door generally indicated at 36.

Figure 4:
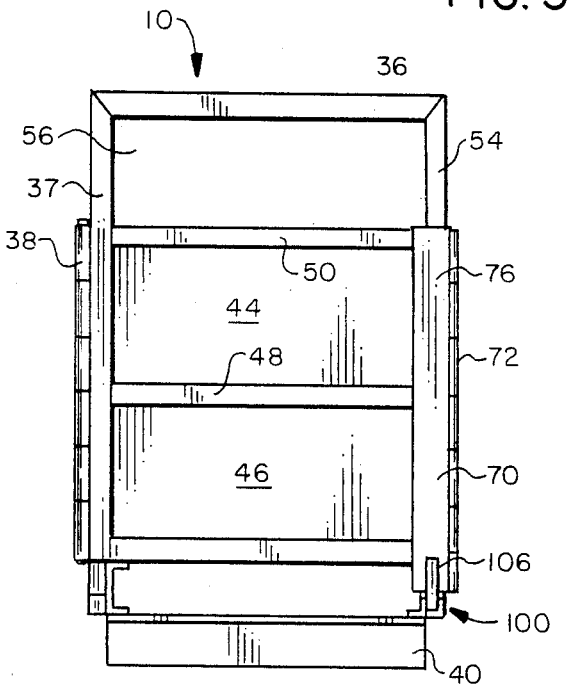
FIG. 4 is an elevational view taken from the left hand end of the compactor of FIG. 3.

Referring to FIG. 4, door 36 is mounted to body 22 by a continuous hinge 38, sometimes referred to as a "piano hinge." Mounting brackets 40 extend substantially the entire width of body 22, providing a convenient, stable mounting of compactor 10 on the bed of a vehicle. Door 36 is further comprised of solid panels 44, 46 with internal bracing members 48, 50 mounted to the exterior surface of the panels. An outer frame 54 surrounds the panels 44, 46 at the outer edges thereof, and according to one important feature of the present invention, extends thereabove to form an intake opening or plastic inlet 56. As will now be appreciated, the plastic inlet 56 generally opposes a plastic inlet 57 at the opposite end 32 of the compactor, which was seen above in FIG. 1, and which is also visible in FIG. 5. It should be understood that frame 54 surrounds the entire end portion of tubular body 22, the tubular body extending generally the full height of frame 54. As will be seen herein, an internal divider wall extends generally from the cross member 50, dividing the interior of tubular body 22 into an upper inlet portion which serves as an inlet chute to deliver plastic containers to drop through an opening 235 to a position in front of a ram 154 located in the lower portion of the body as a receiving chamber 138 to hold the crushed containers.

Figure 7:
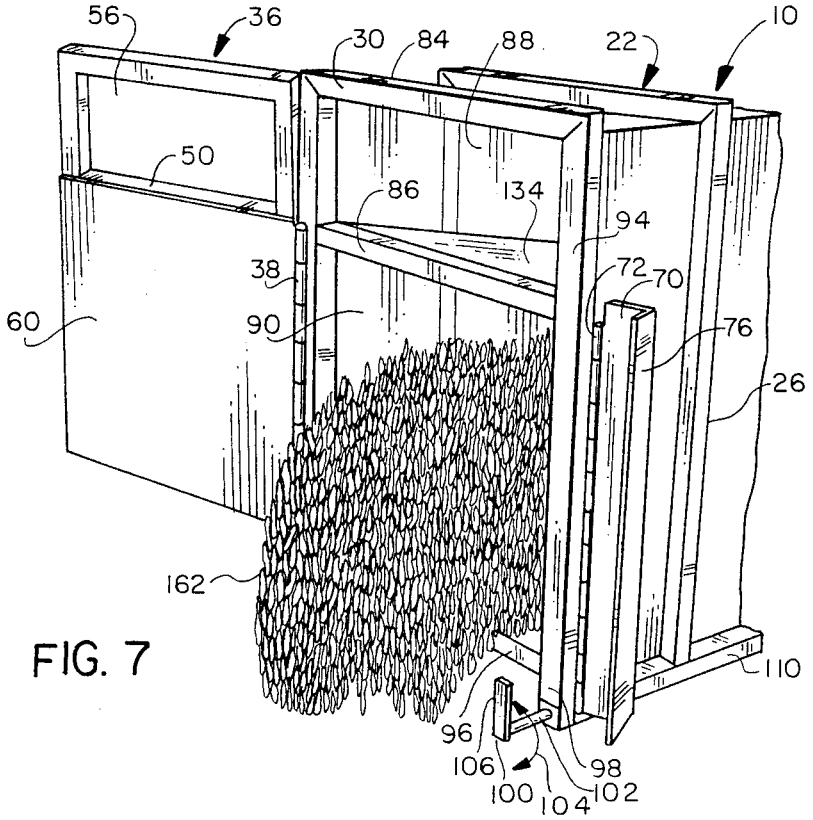
FIG. 7 is a fragmentary perspective view of the compactor illustrated in FIG. 4, showing discharge of compacted material.

Referring additionally to FIG. 7, door 36 is shown in an open position to expose an interior surface 60 against which, as will be seen herein, the waste is compacted. The cross braces 48, 50 and the frame 54 play an important role in preventing the outward bulging of the door panels during waste compaction. Preferably, the aforementioned door panels 44, 46 comprise upper and lower portions of a single integral metal sheet, one major surface of which comprises the interior door surface 60.

According to the present invention, door 36 is pivotally mounted at only one lateral side 37 thereof (see FIG. 4). As will be seen herein, the waste-compacting ram works against door 36 to compress waste processed by the compactor. Accordingly, it is important that door 36 be supported not only against bulging as was pointed out above, but also against opening during the compaction operation. Accordingly, there is provided a clamping bar 70 which, as can be seen in FIG. 4, overlaps and edge of door 36 opposite hinge 38, cooperating with the hinge to prevent an outward displacement of the door. The clamp 70 is preferably secured to frame 22 by a continuous ("piano") hinge 72. The clamp 70 preferably has an L-shaped cross-section with one leg at the free end of the clamp, herein denoted by the reference numeral 76, overlapping the frame 54. As can be seen in FIG. 3, for example, the remaining leg 78 overlaps a lateral edge 80 of frame 54. The leg 76 provides a full length engagement with door frame 54 over the height of the compaction surface 60. Because the legs 76 and 78 are integral, most of the compaction force applied to the leg 76 applies a tensile force to the leg 78 to try to pull it from the piano hinge. This provides a very strong door lock against compression forces that are usually in the range of 20,000 to 20,000 pounds with ram pressures of 1,600 to 2,200 psi across the face of the ram.

Referring again to FIG. 7, the free end 30 of tubular body 22 includes a rectangular outer frame 84 and an internal cross member 86 forming a division between an intake opening 88 and a discharge opening 90. The frame 84 further includes a vertical member 94 extending below the lower cross member 96 with an extension portion 98, which provides mounting for a locking member 100, rotatable back and forth about the axis of a mounting shaft 102 in the direction of arrow 104. The locking member includes an arm 106 which, as can be seen in FIG. 4, is dimensioned to overlie the leg 76 of clamp 70. The actuating shaft 102 of lock 100 is conveniently mounted within a lower support member 110.

Figure 12:
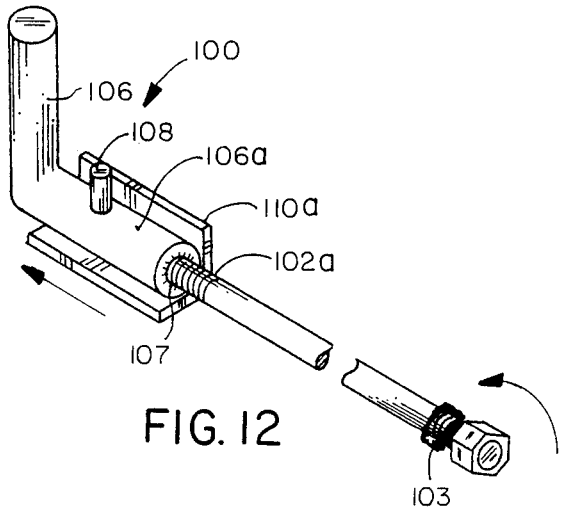
FIG. 12 is a diagrammatic view of a locking member movable by an actuating shaft.

According to one aspect of the present invention, shaft 102 extends between both ends 30, 32 of tubular body 22, to accomplish a number of important advantages. Referring again to FIG. 3, and also to FIG. 5, the remote end of actuating shaft 102 is accessible from right end 32 (FIG. 2) of the tubular body 22. The end of the actuating shaft is preferably terminated at a head member 114 so as to have a shape similar to that of an hexagonal fastener head. As best seen in FIG. 12, the shaft 102 is mounted to turn in a fixed hollow bracket 103 fastened to the frame and a pair of collars 104 are fastened to the shaft 102 adjacent the ends of the bracket to prevent axially translation of the shaft as it turns in the bracket 103. The left end **102*a* of the shaft is threaded into a threaded bore 107 horizontal arm 106*a*** of the locking member 100. The lower support member 110 in which the shaft rotates has a square cross-sectional portion 110a which prevents the locking member 110 from rotating as the screw shaft end 102a is threaded further into or threaded from the threaded bore 107 in the locking member arm 106a. Thus, the locking member is translated to the left away from the door clamp 70 to open the door and is translated to the right to bring the locking arm 106 against the door clamp 70 to swing it to its closed locking position.

Figure 13:
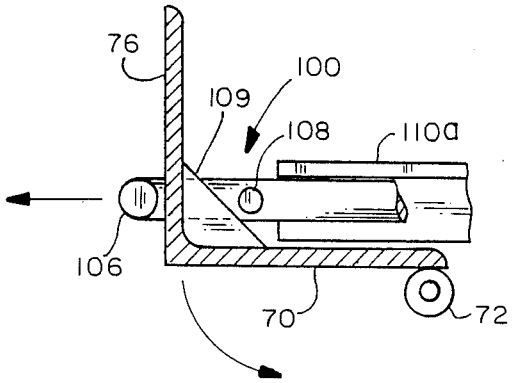
FIG. 13 is a diagrammatic, cross-sectional plan view of the locking member and door clamp.

It has been found that the door clamp 70 may not always be forced open under the pressure of the door when the leg 106 is moved to the left, as viewed in these Figures. Thus, it is preferred to positively drive the door clamp 70 to its release or unclamping position. To this end, as best seen in FIGS. 12 and 13, a second camming bar 108 is mounted on the locking member 110 to cam against a cam plate 109 fitted diagonally between the vertical legs 70 and 76 of the door clamp 70. The cam bar 108 is disposed inwardly of the vertical clamp leg 76 while the vertical arm 106 is disposed outwardly of the vertical clam leg 76. Thus, when the locking member moves to the right, the locking arm 106 moves to abut the outer side of the clamp leg 76 and pivot the clamp 70 about its hinge axis at hinge 72 to close and to lock the clamp against the door. When the locking arm is translated to the left, the camming bar 108 hits and cams against the inclined edge of cam plate 109 to pivot the clamp in the opening direction which is counterclockwise about the hinge 72 in FIG. 13. Accordingly, by applying a wrench to the head 114, the actuating shaft 102 can be rotated about its axis, bringing vertical arm 106 into locking engagement with the clamp 70 and rotated in the other direction to cam the vertical arm 106 to a position where the door can swing open. Also, a suitable handle or operating crank could be secured to head 114 if desired, to provide a further ease of operation.

As will be appreciated by those skilled in the art, plastic materials have a "memory" and when compressed exhibit a certain amount of spring-back when the compressing pressure is released. Such would occur, for example, upon the unlocking of lock 100, with clamp 70 being swung about hinge 72 under the stored pressure internal to tubular body 22, bearing against door 36.

Accordingly, it has been found desirable to provide a remote actuation of shaft 102 and with the preferred arrangement of the present invention, an operator is protected from any risk of injury during a discharge operation. A further safety advantage is realized in that an operator can stand at the upper end of a tilted compactor during a tilting discharge operation, such as that illustrated in FIG. 2.

It has been found convenient to place controls for the hydraulic lift cylinder and piston 120 at that side of vehicle 14 adjacent the compactor ends 32. Thus, while standing at a single position remote from the discharge end of the compactor, an operator can safely complete a discharge operation, being remotely positioned not only from the swinging door 36, but also from the discharge end of the tilted compactor. Having the hydraulic lift cylinder and piston mounted in the space below the unit and extending generally horizontally provides a compact and small mechanism on the truck for tilting the compactor unit. The controls may be in the form of push buttons to start or stop the ram operation or a swinging lever which drives the ram in one direction when the lever is swung in a first direction, and which drives the ram in the opposite direction when the lever is swung in a second direction.

Referring again to FIG. 5, the second end 32 of tubular body 22 is preferably finished with a frame 124 surrounding the outer periphery of the tubular end. An access door 126 closes the lower portion of end 32. Access door 126 is supported at its upper edge by a continuous hinge 128. A series of screw fasteners 130 maintain the access door in a closed position, the screw fasteners being received in the upright, vertical members of frame 124. As will be seen herein, the door 126 provides access to the hydraulic operating equipment, and with removal of fasteners 130, the door can be swung in an upward direction allowing the insertion and removal of hydraulic equipment within an equipment chamber formed within the tubular body 22.

Figure 5:
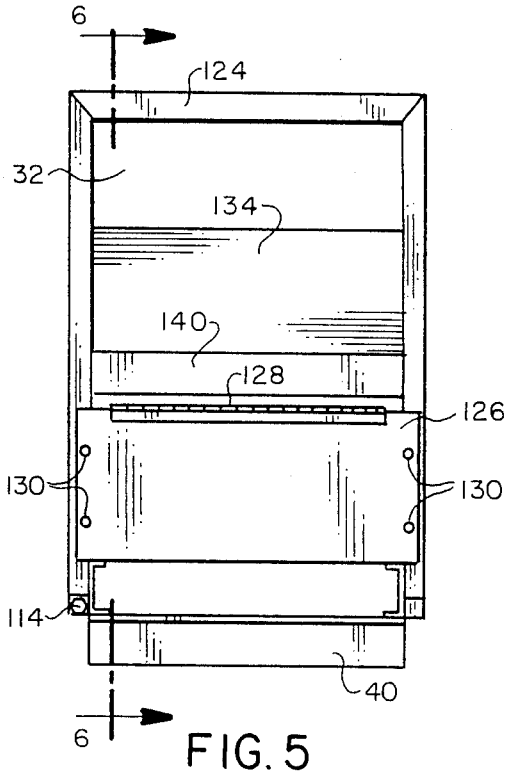
FIG. 5 is view of the opposed end of the compactor, taken from the right hand end of FIG. 3.
Figure 6:
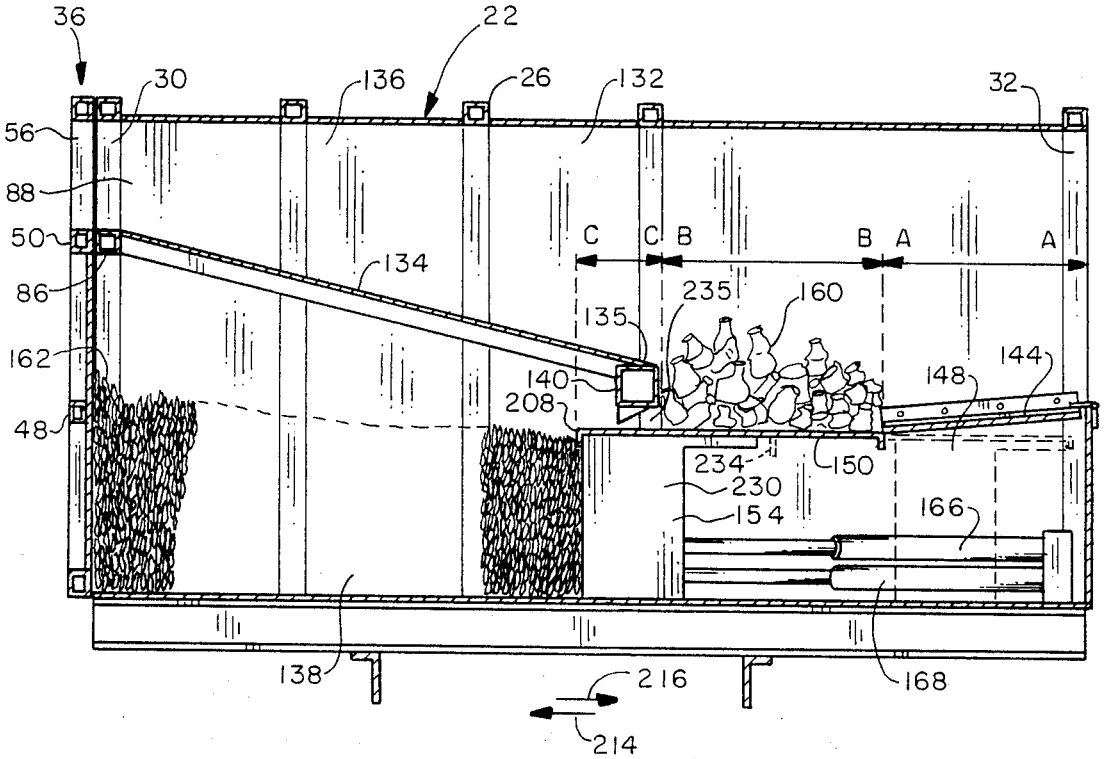
FIG. 6 is a cross-sectional view taken along the line 6—6 of FIG. 5.

Turning now tho FIGS. 5–7, the tubular body 22 has a holloW interior 132 divided by interior 132 divided by internal divider walls 134 and 144 separating the interior 132 into an upper inlet chamber 136 and a lower compaction chamber 138 and a lower ram chamber 148. To cause the plastic containers deposited on the left hand side of FIG. 5 to side down to the entrance to the compaction ram, the divider wall 134 is preferably inclined, extending between a higher cross member 86 (previously described with reference to FIG. 7) and a lower cross member 140 located adjacent the center of the tubular body 22. The other end 32 of the tubular body has an internal divider wall 144 which also is downwardly inclined toward the center of the tubular body to cause containers to slide toward the opening above the ram. The divider wall 144 divides the interior of the tubular body into an upper or inlet portion or chute 136 and a lower portion having the receiving chamber and the ram chamber 148. In accordance with the present invention, the ram chamber which is the space or volume occupied by the ram is kept very short, e.g., eighteen inches in length between the arrows A—A in FIG. 6 which is the distance between front ram face 197 and the right hand end 32 of the compactor while a long stroke length, e.g., twenty-seven inches, is provided for the ram in its compaction stroke. The twenty-seven inch stroke includes the opening distance of twenty or more, which is indicated by arrows B—B in FIG. 6, and a six or seven inch compaction stroke penetration into the receiving chamber shown by the arrows C—C in FIG. 6. The receiving chamber is about five feet in length from the door to the inner end of the inclined plate 134. It is important to have a large opening, e.g., twenty-two inches, between the ends of inclined plates 134 and 144 to receive and hold a substantial quantity of plastic containers for compaction so that a single compaction stroke crushes a large number of containers and so that the operator need not keep actuating the compaction ram so often. The large penetration of the ram into the receiving chamber assures that when the ram retracts and so of the containers spring back toward the retreating ram, these containers do not again fall into the opening to take up space needed for the new incoming uncrushed containers.

Figure 10:
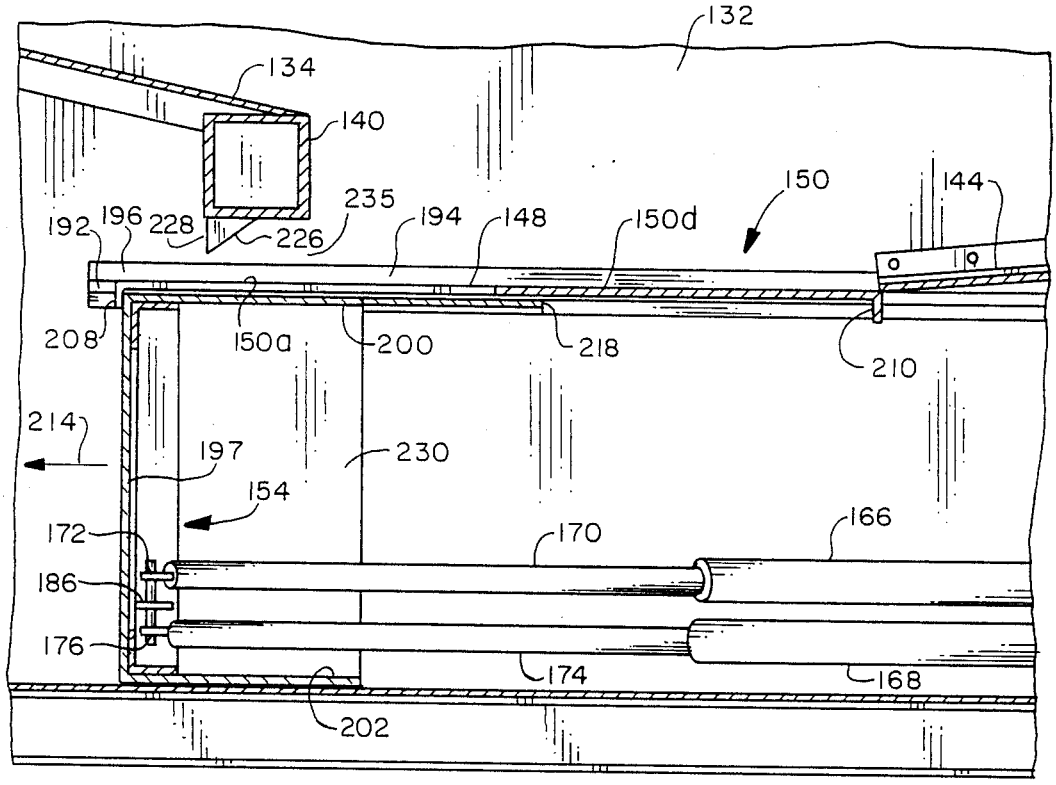
FIG. 10 is a fragmentary cross-sectional view showing the right hand portion of FIG. 6 in greater detail.

The ram chamber may be kept quite small by use of a ram means 153 having an overlapping coverplate 150 and a ram 154 and a pair of diagonally-crossed cylinders 166 and 168. When the coverplate 150 is extended to cover the opening 150, as shown in FIG. 6, the coverplate covers the opening of twenty-two inches and the ram 154 extends seven inches beyond the opening into the receiving chamber. This is about a twenty-nine inch stroke for the ram. When the ram is retracted, the ram slides beneath the coverplate to abut a depending lip 210 on the coverplate, as shown in FIG. 10, to pull the coverplate back to beneath the inclined plate 144. The illustrated compactor has a compaction chamber volume of 0.23 cubic yard and a receiving container volume for crushed containers of 1.00 cubic yard. The ram pressure may be in the range of 1,600 to 2,200 psi to provide a packing force at the ram face in the order of 22,600 to 31,100 pounds. The illustrated dual cylinders have a three-inch bore and a two-inch piston rod. The overall length is eight feet, i.e., across the truck width and height of three feet and a depth of three feet on the truck. These dimensions are by way of example only. The weight is 1,820 pounds. If the size is increased to a four-foot depth and four-foot height, the receiving compartment may be increased to 2.00 cubic yard and the stroke increased to 39 inches with a packing force of 40,300 to 55,400 pounds at 1,600 psi to 2,200 psi. This is by way of example only. As will be seen herein, the equipment within chamber 148 includes hydraulic cylinders for moving a compacting ram means 153 back and forth in the directions of double-headed arrow 156. As indicated in FIG. 6, ram 153 intrudes into receiving chamber 138 so as to compress waste material such as bottles or the like indicated by the reference numeral 160 into a compacted mass 162.

The space available for a ram stroke is kept very limited so that the compaction compartment may be kept large. It is preferred to use crossed cylinders 166 and 168 rather than a straight axially extending cylinder to reduce the space needed for a given stroke length versus a linear, axially-aligned cylinder of the same stroke length thereby leaving more space available for the compaction chamber.

Figure 9A:
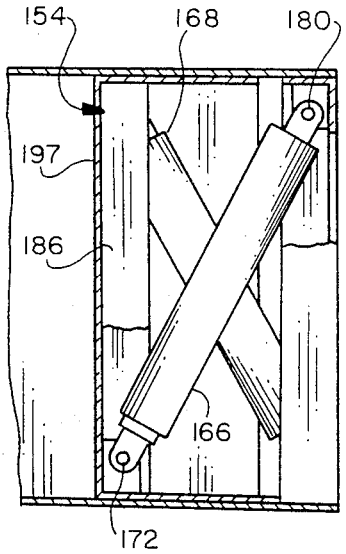
FIGS. 9A and 9B are fragmentary top plan views, taken in cross-section, showing the hydraulic cylinders which operate the waste-compacting ram.
Figure 9B:
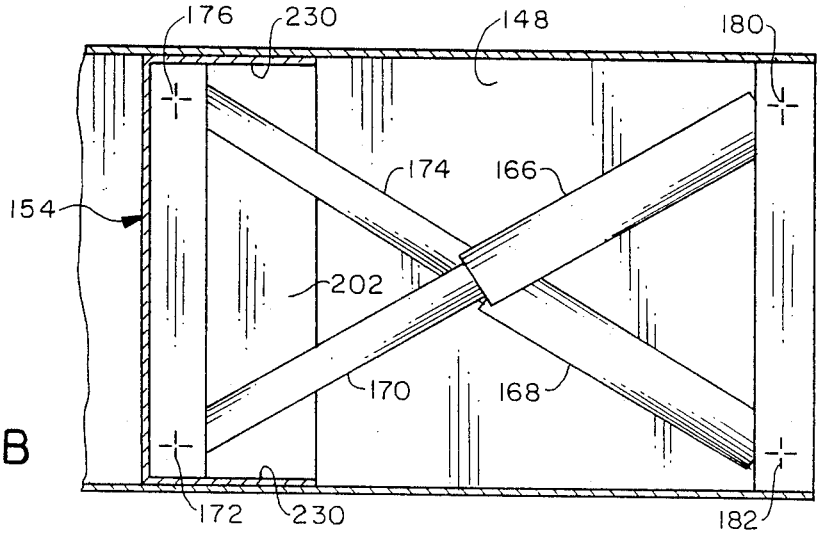

Referring now to FIGS. 6, 9 and 10, the equipment within ram chamber 148 includes upper and lower hydraulic cylinders 166, 168 respectively. The cylinder 166 includes a piston 170 connected to ram 154 at a mounting pin connection 172. A second pin 176 connects a piston 174 of cylinder 168 to an opposite end of ram 154. Referring to FIG. 9B, for example, the pistons 170, 174 are shown in an extended position. As is made clear in the figure, the cylinders 166, 168 and accordingly the pistons driven therein are crossed one over the other, and extend between the diagonal corners of the equipment chamber 148 to provide a maximum compaction force in a minimum volume. FIG. 9A shows the cylinders 166, 168 in a contracted position, and with comparison to FIG. 9B the amount of travel of ram 154 can be readily appreciated. In FIG. 9A, a pin connection connects one end of cylinder 166 to the frame of tubular body 22. A similar pin connection 182 provides securement for cylinder 168. As can be seen in FIGS. 9 and 10, the pin connections 172, 176 to ram 154 are preferably made on opposite sides of a cross member 186 which spans the width of the tubular body. Not visible in the figures are the hydraulic pump and the power source therefor providing hydraulic pressure within the cylinders 166, 168. Any suitable conventional arrangement can be used for the hydraulic power source.

Herein, using the crossed cylinders the ram and cylinders take only about eighteen inches of space leaving about a 24-inch wide inlet opening between the inclined divider walls 134 and 144, leaving about 54 inches available for the compaction chamber beneath the inclined wall 134. Thus, there is achieved a very large receiving chamber 138 to hold a large volume of crushed containers before the truck needs to be driven to a discharge location.

Figure 14:
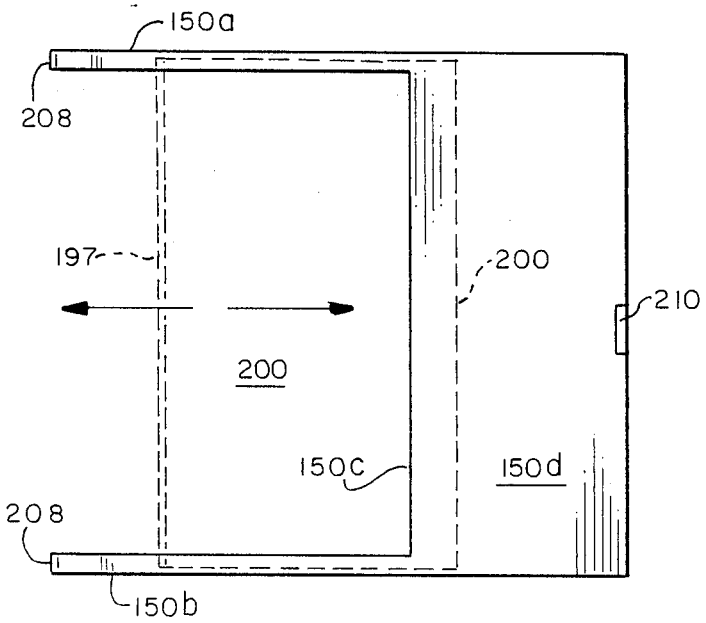
FIG. 14 is a plan view of a cover plate overlying a top plate of the ram.

The coverplate 150, shown in full lines in FIG. 14, resists bending or warping or cocking because of uneven forces applied thereto or material being wedged between the coverplate and upper plate member 200 of the ram. The coverplate is in the form of a tray with two long arms **150*a* and 150*b* which extend forwardly toward the receiving chamber and from front edge 150*c* of a top sheet 150*d*. The top sheet 150*d* is a solid imperforated sheet which cooperates to cover the righthand half of the opening when the ram is fully extended, as shown in FIG. 10. The lefthand position of the opening is covered by the ram upper plate 200 in FIG. 10. Together the top sheet 150*d* and top plate 200 cover the opening and prevent plastic from being dropped down through the opening 235 to a position behind the ram when it is fully extended. If the opening isn't covered, plastic will fall behind the ram and be pushed to the right, as viewed; in FIG. 10**, and eventually clog and damage ram operation.

Figure 11:
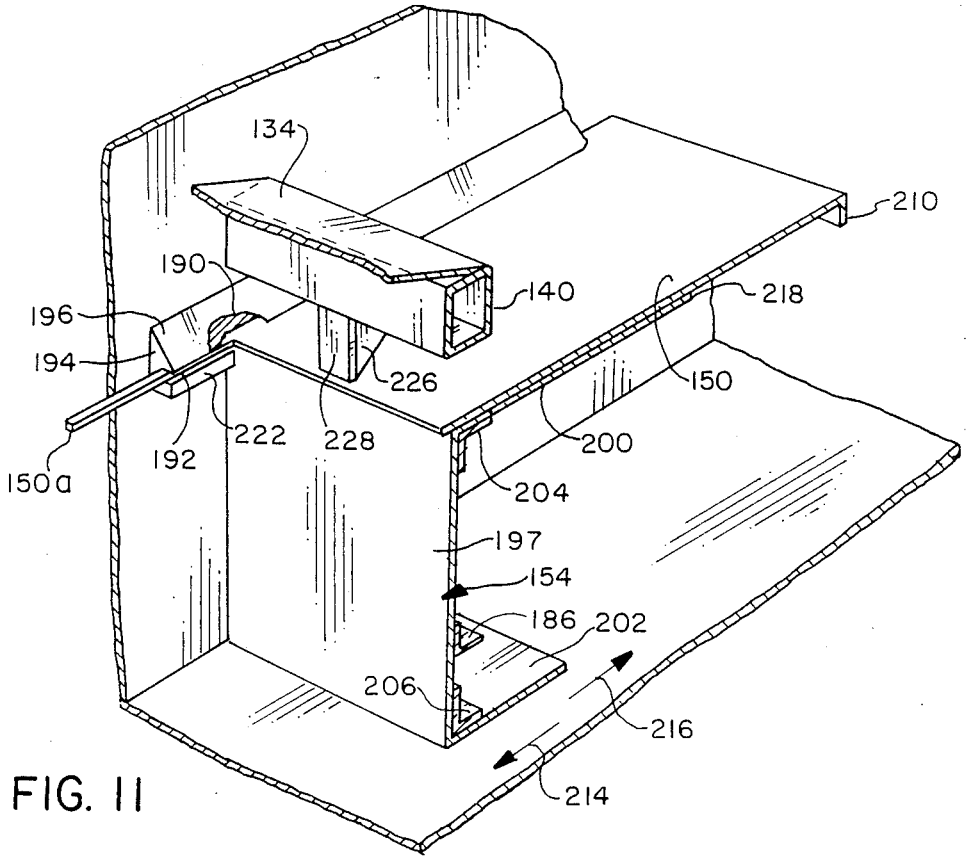
FIG. 11 is a fragmentary perspective view shown partly broken away, of the waste-compacting ram and sliding cover components.

The long, forward-extending arms **150*a* and 150*b* of the cover plate 150 are slidable in grooves 192 in a pair of opposed support rails 194, as best seen in FIG. 11. The arms 150*a* and 150*b* are separated by open space 235 through which space the incoming plastic containers drop when the cover plate is retracted. In the retracted position, the arms 150*a* and 150*b* are in the guide rails with an opening therebetween. A support rail 194 preferably has a generally triangular cross-sectional configuration with a sloping upper surface 196 which preferably overlaps a substantial portion of arm 150*a* or 150*b*. With the long arms in the channels the upper sheet cannot cock or twist very well relative to the underlying upper plate 200 of the ram. Thus, a twisting is resisted at the ends of the arms, which are in the channels at much longer distances, than is possible if the arms 150*a* and 150*b* are not present. Likewise, the long arms in the channels resist lifting of the front edge 150*c* relative to the underlying ram plate 200, as may be caused by plastic trying to wedge between the top sheet 150*d* and top plate 200**.

The cover plate 150 is pushed in lefthand direction to cover the opening when the ram face 197 moves to abut the depending ears 208, located at the outer free ends of the arms **150*a* and 150*b*. When the ram travels in the opposite direction, trailing edge 200*a* (FIG. 14) on the ram top plate 200 hits a depending lip 210 projecting down into the path of travel of the trailing edge 200*a*. The cover plate 150 remains stationary when the ram face 197 is spaced from the ears 208 on the arms and the trailing edge 200*a* is spaced from depending lip 210**.

In the preferred embodiment, the ram 154 is made of a suitably thick metal sheet which is bent, welded or otherwise joined to form a face plate 197 and upper and lower plate members 200, 202. With reference to FIG. 6, the ram 154 preferably includes side plate members 230 to further support the lateral sides of the front plate of ram 154. In the preferred embodiment, angle beams 204, 206 join the ram face 197 to the upper and lower plate members. Thus, the ram forms a hollow rectangular tray-like member which is stood on-end. Preferably, a close fit is provided between the side and bottom plates and the housing body. The ram therefore wipes against the body walls to completely process the waste inputted to the system and to seal the equipment chamber formed behind ram 154 enclosing the cylinders 166 and associated hydraulic and linkage equipment. It is preferred to make the plates 202, 230 and the top plate 200 out of a "tough", wear resistant steel. These members could be coated with a low friction material such as TEFLON, or roller bearings could be embedded in the members. Such precautions against wear have not been found to be necessary, especially when the optional sealing arrangement of FIG. 8 is used.

Figure 8:
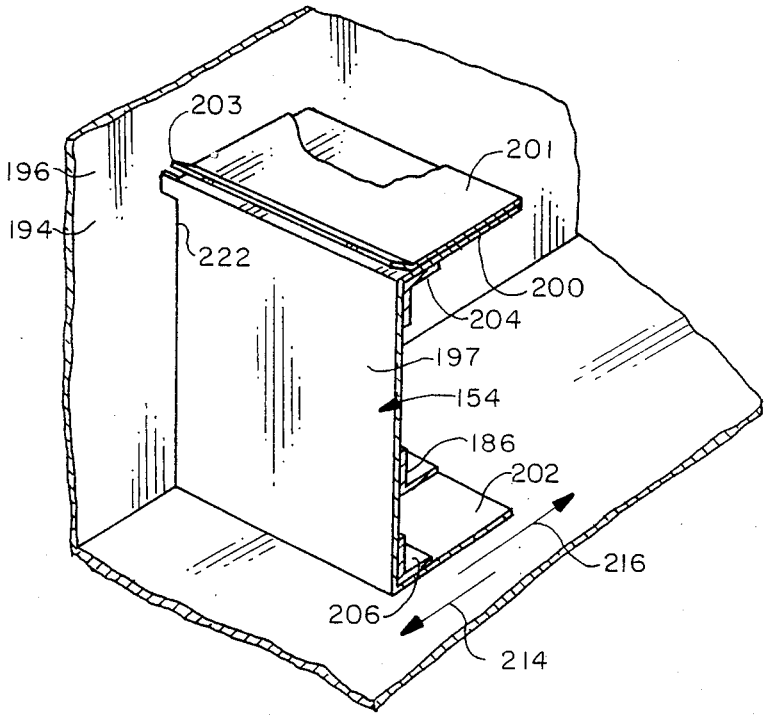
FIG. 8 is a partial perspective view of a seal for the waste-compacting ram.

Turning now to FIG. 8, a seal 201 may be employed if waste is found to intrude between ram top plate 200 and cover 150. The seal 201 is preferably formed of a flexible, shape retaining, low friction material such as TEFLON. The seal 201 includes a front sealing flap portion 203 which is angled upwardly against the bottom surface of the cover 150, to scrape thereagainst as the cover and ram slide against one another. An additional sealing flap could be provided at the rear end 218 of top plate 200 if desired. The seal 201 is preferably formed from sheet material and is secured to top plate 200 of ram 154 using suitable means. Similar seals with upstanding angled sealing flaps could be employed at other surfaces of the ram, if desired.

In addition to having the crossed cylinders to reduce the space needed for the compaction unit, the separate sliding cover plate 150 and the separate ram substantially reduces the length of the ram and the space needed therefor. When the cover plate and ram are retracted to the dotted line position of FIG. 6, the ram's upper plate is slid beneath cover plate. When the ram is extended, its upper plate 200 travels to the left and pulls the cover plate 150 behind it so that the effective upper side of the ram is doubled and covers the inlet opening to the ram.

According to an important feature of the present invention, neither the ram face plate 197 nor the upper plate 200 thereof are secured to the sliding cover plate 150, but rather are free to slide thereagainst. When ram 154 is moved in the forward direction 214, the upper edge of ram 154 contacts the depending ears 208 causing the cover plate 150 to travel therewith and to slide to cover right hand half of the opening 235 between the inclined plates 134 and 144. The lefthand half is covered by the ram top plate 200. Because the opening 235 is covered, containers or other plastic material thrown into the compactor, while the ram is extended, cannot fall behind the ram and build up behind the ram as it retracts.

When the ram 154 is moved in the rearward direction 216, the cover plate is initially free to remain stationary as the ram 154 and top plate 200 slide in the direction of arrow 216. Eventually, the rearward edge of upper plate 200 contacts the rearward lip 210 thereupon causing the sliding cover plate 150 to travel in the rearward direction, along with ram 154.

In addition to providing a channeled securement for the side edges of cover plate 150, the guide rail 194 also prevents upward displacement of the ram which might allow an ingress of foreign material underneath the bottom plate member 202, thereby posing a risk of jamming or otherwise impeding the motion of the ram.

To aid in scooping of material from the top plate of the ram during its return stroke, a downward tooth-like projection 226 is mounted to cross member 140, at a lower surface thereof. The projection 226 has triangular side faces, being relieved in the direction of arrow 216. The forward face 228 of the projection also helps block a passage of compacted waste material from compaction chamber 138 into receiving chamber 136, upon retraction of the sliding cover 150 in a direction of arrow 216. If desired, the projection 226 could be made to extend the entire width of the tubular chamber. Thus, it can now be seen that the ram 154 is provided with an improved restraining which prevents the migration of foreign material there-behind as the ram travels back and forth in its directions of operation.

FIG. 6 shows the range of motion of the ram 154, with the ram shown in the fully extended position in solid lines and in a fully retracted position in phantom lines. As the ram is moved to the fully retracted position, i.e., fully displaced in the direction of rearward arrow 216, the cover plate 150 assumes its fully retracted position, with the depending ears 208 thereof being located at the position indicated by reference numeral 234. With the ram 154 retracted opening or passageway 235 between the compaction and receiving chambers is opened, thereby allowing waste material to pass from the inlet chamber to in front of the compaction ram, ready for a subsequent compression stroke by the cylinders 166, 168.

Thus, a substantial opening or passageway 235 is formed between position 234 and the interior end 135 of divider wall 134, that end joined to cross member 140. Waste is thereby allowed to fall into the compaction chamber, and is allowed to flow with a gravity slope toward the retracted ram 154. Due to the overhanging cover plate which extend beyond the ram face 197, the ram is allowed a certain amount of "free" or nearly free travel at the initial portion of its compression stroke. With the expansion of the pistons within cylinders 166, 168, waste is compacted against the closed panels of door 36. According to one feature of the present invention, ram compression is directed into an expanding chamber, so configured by the inclination of divider wall 134. This provides a more jam-proof discharge of compacted material. As will now be appreciated, the same inclination of divider wall 134 provides a maximum internal receiving cavity within the tubular body while allowing an ample sized compression chamber for storing larger amounts of compacted material than was heretofore possible. Accordingly, by using a compactor according to principles of the present invention, an operator of vehicle 14 can travel a longer collection route before having to return to a processing site.

Eventually, the compacted mass 162 compressed by ram 154 fills the receiving chamber 138. Upon arrival at a processing site, an operator of the vehicle, positioned at the end 32 of the tubular body actuates the lock 100 by turning shaft end 114. As the arm 106 clears clamp 70, the door 36 will be forced as camming bar 108 cams against cam plate 109 or, in some instances, the spring-back forces stored in the compressed waste, the clamp 70 being pushed free of the door, to the position roughly illustrated in FIG. 7. By operating the ram repetitively, most the compacted material will spill outwardly from the compaction compartment. The person will manually have to reach into the compaction compartment to pull out the remaining crushed containers. In the embodiment shown in FIG. 2, the hydraulic cylinder 120 can be used to tilt the compactor unit to slide the crushed containers from the compaction chamber by the pull of gravity.

Preferably, however, the compactor constructed according to principles of the present invention is fixedly mounted to the trailer bed of vehicle 14, with discharge being quickly and easily accomplished by extending the pistons in cylinders 166, 168 to their forwardmost position, thereby pushing the compressed mass 162 toward the discharge opening 90. It is expected that the receiving chamber 138 will not be completely emptied by the ram operation, and accordingly an operator can pull pieces of the compacted mass through the discharge opening, once the stored forces within the receiving chamber had been safely released in the aforedescribed manner. Several extensions of ram 154 toward the discharge opening and the subsequent retractions of the ram will free most of the compacted plastic and the operators will then manually remove what is left in the compaction chamber until it is emptied.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. In a refuse collection vehicle, the combination comprising:

a vehicle having a front, rear and sides, and an elongated bed;

a plurality of separate refuse units on the vehicle each for receiving a separately classified refuse;

one of said refuse units comprising a compactor unit for compacting plastic containers therein, said compactor unit extending transversely across the width of the elongated vehicle bed from one side to the other side of the vehicle;

said compactor unit having a body with inlet openings at opposite sides of the vehicle to allow plastic containers from opposite side of the vehicle to be deposited in the body, a compacting ram means in said compactor unit body moveable transversely across the vehicle body for compacting the plastic containers, the ram means movable between a retracted position and an extended position for engaging and crushing the plastic containers;

a chamber in the compactor unit body for the ram means, a receiving chamber in alignment with the ram means and in said body for receiving compacted plastic containers pushed therein by the ram means and for holding and storing the compacted plastic container units; a passageway between the receiving chamber and the ram means into which the containers being deposited fall before the compacting ram means pushes the containers into the receiving chamber;

means for securing said compactor unit to the vehicle; and discharge door means for the receiving chamber at a side of the vehicle movable between open and closed positions to allow discharge of the compacted plastic containers when the discharge door means is in an open position while the compactor unit remains secured to the vehicle, one of the inlet openings for the depositing of containers being located above the receiving chamber, and the other of the inlet openings for the depositing of containers being located above the chamber having the ram means therein.

2. A vehicle in accordance with claim 1 in which a fluid actuator is mounted on the vehicle and is extendable to tip the refuse unit upwardly to discharge the compacted refuse through the discharge door means.

3. A vehicle in accordance with claim 1 in which the unit body is generally box-shaped;

said compacting ram means being mounted at one end and having crossed diagonally extending hydraulic actuators to reduce the space needed for a ram stroke;

said ram means including a ram and a separable slidable cover plate which overlaps when the ram means is retracted to reduce the space needed for the ram means.

4. A vehicle in accordance with claim 1 including a door-locking means for locking the door in closed position;

and remote operating means for the door-locking means to operate the door-locking means to allow the door to open under the pressure of the compacted plastic containers while the operator is at a safe remote position relative to the door means.

5. The refuse collection vehicle of claim 1 in which the truck bed is approximately eight feet in width, and the receiving chamber for the compacted containers is four feet six inches in length in the transverse direction, and in which the passageway is about twenty inches in transverse length and in which retracted ram means is about eighteen inches in transverse width.

6. An apparatus in accordance with claim 1 in which the width of the compactor unit across the truck bed is about eight feet and the compactor unit has a depth of about three feet and height of about three feet, and the receiving chamber has a volume of at least one cubic yard.

7. An apparatus in accordance with claim 1 in which the width of the compactor unit is about eight feet with a height of about four feet and a depth of about four feet, and the receiving chamber has a volume of at least two cubic yard.

8. In a refuse collection vehicle, the combination comprising:

a vehicle having a front, rear and sides, and an elongated bed;

a plurality of separate refuse units on the vehicle each for receiving a separately classified refuse;

one of said refuse units comprising a compactor unit for compacting plastic containers therein, said compactor unit extending across the width of the elongated vehicle bed from one side to the other side of the vehicle;

said compactor unit having a body with inlet openings at opposite sides of the vehicle, and an upper portion of the body to allow plastic containers from opposite side of the vehicle to be deposited in the body, divider walls in the body forming a chute to direct the incoming plastic containers to drop through a passageway into a lower portion of the body, said divider walls dividing the body into upper and lower portions, a compacting ram means in the lower portion of said body and moveable transversely across the width of the vehicle for compacting the plastic containers dropped through the passageway into position before the ram means for engaging and crushing the plastic containers;

a receiving chamber in the lower portion of the body and in alignment with the ram means and in said body for receiving plastic containers being pushed across an opening by the ram means and for holding and storing the compacted plastic container units;

means for securing said compactor unit to the vehicle; and discharge door means in the lower portion of the body movable between open and closed positions to allow discharge of the compacted plastic containers from the receiving chamber when the discharge door is in an open position and while the compactor unit remains secured to the vehicle.

9. A vehicle in accordance with claim 8 in which:

said compacting ram means is mounted at one end of the body and has crossed diagonally-extending hydraulic actuators to reduce the space needed for a ram stroke;

said ram means including a ram and a separable slidable cover plate which overlaps the ram when the ram is retracted to reduce the space needed for the ram means.

10. A vehicle in accordance with claim 8 including a door-locking means for locking the door in a closed position;

and remote operating means for the door-locking means to operate the door-locking means to allow the door to open under the pressure of the compacted refuse while the operator is at a safe remote position relative to the door means.

11. In a refuse collection vehicle, the combination comprising:

a vehicle having a front, rear and sides, and an elongated bed;

a plurality of separate refuse units on the vehicle each for receiving separately classified refuse;

one of said refuse units comprising a compactor unit for compacting plastic containers therein, said compactor unit extending across the width of the elongated vehicle bed from one side to the other side of the vehicle;

said compactor unit having a body with an inlet opening to allow plastic containers to be deposited in the body, a compacting ram means in said body for compacting the plastic containers deposited through the inlet opening by engaging and crushing the plastic containers;

a receiving chamber in said body for receiving compacted plastic containers pushed therein by the ram means and for holding and storing the compacted plastic containers;

means for securing said compactor unit to the vehicle;

discharge door means for the receiving chamber movable between open and closed positions to allow discharge of the compacted plastic containers when the discharge door is in an open position while the compactor unit remains secured to the vehicle, said ram means including a ram slidable in the body between a rear retracted position and a forward extended position, a sliding cover plate overlapping the ram when the ram is in its retracted position, said cover plate having forwardly extending elongated arms projecting outwardly from a rearward plate to partially cover the opening, guide rails on the body for slidably-supporting opposite edges of the rearward plate and edges of the elongated arms;

said elongated arms being disposed in the guide rails forwardly of the rearward plate, which when it is retracted with the ram thereby leaves the opening uncovered for the dropping of plastic containers.

12. A refuse collection vehicle in accordance with claim 11 in which first ram engaging means are provided on the elongated arms to be engaged by the ram to pull cover plate to assist in covering the opening and in which second arm engaging means are provided on the rearward plate to be engaged by the ram to pull the cover plate to the retracted position.

13. A vehicular-mounted waste compactor, comprising:

a tubular body having first and second opposed ends;

means at the first end of said body defining intake and discharge openings;

means at the second end of said body defining an intake opening;

a door at the first end of said body, defining an opening cooperating with the intake opening thereat and including means for blocking said discharge opening;

means at the second end of said body defining an intake opening;

a pair of opposed divider walls within said body dividing the interior of said body into a receiving chamber communicating with said intake openings and a compaction chamber, said divider walls spaced apart so as to define a passageway therebetween communicating between said compaction and said receiving chambers; and a ram movable toward said door to a protracted position for compacting waste received in the compaction chamber, and movable away from said door to a retracted position; and said door moveable between open and closed positions for discharge of the waste from the compaction chamber upon movement of said ram toward said protracted position and for blocking said discharge opening during compaction of waste in the compaction chamber.

14. The apparatus according to claim 13 further comprising clamp means for selectively clamping said door in the closed position, said clamp moveable to a release position to permit opening of said door.

15. The apparatus according to claim 14 further comprising an actuator adjacent the second end of the body for moving the clamp between clamped and released positions, the actuating means operable remotely from said door to prevent risk of injury to an operator when the door is unclamped.

16. The apparatus according to claim 15 in which the clamp means comprises a right angle having a first vertical leg pivotally mounted on the body and an integral second leg swingable to engage the door, said actuator means includes an elongated shaft and a locking member movable by the shaft to cam against the angle to force the angle to pivot its second leg toward or from the door.

17. An apparatus in accordance with claim 16 in which the locking member comprises a reciprocable member having a first projection to engage the outside of the second leg to pull the second leg against the door, an inclined surface is provided between the first and second legs, and a projecting cam member is provided on the locking member to engage the inclined cam surface to pivot the second leg away from the door to allow the door to open.

18. In a refuse collection vehicle, the combination comprising:

a vehicle having a front, rear and sides, and an elongated bed;

a plurality of separate refuse units on the vehicle each for receiving a separately classified refuse;

one of said refuse units comprising a compactor unit for compacting plastic containers therein, said compactor unit extending across the width of the elongated vehicle bed from one side to the other side of the vehicle;

said compactor unit having a body with inlet openings at opposite sides of the vehicle to allow plastic containers from opposite sides of the vehicle to be deposited in the body, a compacting ram means in said body for compacting the plastic containers by engaging and crushing the plastic containers;

a receiving chamber in alignment with the ram means an in said body for receiving compacted plastic containers pushed therein by the ram means and for holding and storing the compacted plastic container units;

means for securing said compactor unit to the vehicle;

discharge door means for the receiving chamber movable between open and closed positions to allow discharge of the compacted plastic containers when the discharge door means is in an open position while the compactor unit remains secured to the vehicle;

the ram means traveling in a direction transversely across the vehicle and the door means being mounted on one end of the compacted unit body opposite the ram means which is located at the other end of the unit compacted unit body.

19. In a refuse collection vehicle, the combination comprising:

a vehicle having a front, rear and sides, and an elongated bed;

a plurality of separate refuse units on the vehicle each for receiving a separately classified refuse;

one of said refuse units comprising a compactor unit for compacting plastic containers therein, said compactor unit extending across the width of the elongated vehicle bed from side to the other side of the vehicle;

said compactor unit having a body with inlet openings at opposite sides of the vehicle to allow plastic containers from opposite sides of the vehicle to be deposited in the body, a compacting ram means in said body for compacting the plastic containers by engaging and crushing the plastic containers;

a receiving chamber in alignment with the ram means and in said body for receiving compacted plastic containers pushed therein by the ram means and for holding and storing the compacted plastic container units;

means for securing said compactor unit to the vehicle;

discharge door means for the receiving chamber movable between open and closed positions to allow discharge of the compacted plastic containers when the discharge door means is in an open position while the compactor unit remains secured to the vehicle;

inclined plates extending downwardly and inwardly from each of the inlet openings toward an opening between the inclined plates with the refuse dropping through the opening to a position in front of the compacting ram means;

and one of the refuse inlet openings being located in the door means above one of said inclined plates, said compacted refuse being discharged through said door means while the compactor remains on the vehicle.

20. In a refuse collection vehicle for receiving and for compacting plastic containers, the combination comprising:

a vehicle having wheels for traveling over street, a body having a hollow interior into which refuse is thrown and stored after being compacted.

means securing said body to said vehicle for travel with the vehicle, means defining a refuse inlet opening for the body through which plastic containers may be thrown into the body, a ram in the body for engaging and crushing the plastic containers;

a receiving chamber in the body for receiving and holding compacted plastic containers, a ram chamber in the body for housing the ram and being spaced from the receiving chamber by an opening into which the plastic containers fall when thrown into the body through the refuse inlet, a discharge door on the body for discharging compacted containers from the receiving chamber while the body remains secured to the vehicle, said ram having a predetermined stroke to extend from the ram chamber to push containers from the opening into the receiving chamber, the ram chamber being substantially smaller in length in direction of ram travel relative to the length of the receiving chamber, the ram including a pair of crossed fluid actuator cylinders located in the ram chamber to reduce the space needed to provide the predetermined stroke for the ram, a cover plate cooperable with the ram and overlapping the ram in the compaction chamber to reduce the space needed for the ram, said cover plate being movable with the ram during its compaction stroke to assist in covering the opening so that containers will not be deposited behind the ram when it is extended, a pair of elongated arms are provided on the cover plate extending forwardly along opposite sides of the cover plate, guide rails are provided on the body to receive opposite edges of the cover plate and to receive the elongated arms to guide the cover plate as it moves, first ram engaging means on the pair of arms engaged by the ram when the ram is moved toward the protracted position, and a second ram-engaging means on the cover plate spaced apart from said first ram-engaging means and engaged by said ram as said ram is moved toward said retracted position.

21. A vehicular waste compactor of a small size for mounting on a vehicle to extend transversely across the width of the vehicle with other recycling units comprising:

a body having first and second opposed side ends for positioning adjacent opposite longitudinally extending sides of the vehicle, said body having a closed top wall, a closed bottom wall, a closed front wall, and a closed rear wall, a first inlet opening at the first end of the body through which waste to be compacted may be deposited, a second inlet opening at the second end of the body through which waste to be compacted may be deposited, divider wall means in the body across which the deposited articles move to drop into a passageway, a compacting ram means located below the divider wall means and to one side of the passageway and moveable across the transverse width of the vehicle from the first end to the second opposed end of the body, a compacted waste chamber for receiving compacted waste located on the other side of the passageway to receive compacted waste, said chamber being located beneath the divider wall means, said compacting ram means being movable in a direction across the width of the vehicle and across the passageway and into the compacted waste chamber to compact waste therein, and a discharge door at one of the ends of the body and at a side of the vehicle movable between closed position during compaction and an open position for discharge of waste upon the ram moving into the chamber while the discharge door is an open position.

22. A vehicular waste compactor in accordance with claim 21 in which one of said inlet openings is formed in said discharge door means.

* * * * *

UNITED STATES PATENT AND TRADEMARK OFFICE

CERTIFICATE OF CORRECTION

PATENT NO. : 4,979,866

DATED : December 25, 1990

INVENTOR(S) : Maxwell Croy

It is certified that error appears in the above-identified patent and that said Letters Patent is hereby corrected as shown below:

IN THE ABSTRACT:

Column 57, Line 2, after "is" insert --a--.

Column 57, Line 7, after "interior" insert --of--.

Column 1, Line 60, change "being" to --be--.

Column 2, Line 5, after "not" insert --a--.

Column 2, Line 41, change "Typical" to --Typically--.

Column 2, Line 63, change "problems" to --problem--.

Column 3, Line 29, change "titled" to --tilted--.

Column 3, Line 34, after "mountable" insert --on--.

Column 4, Line 32, after "is" insert --a--.

Column 6, Line 24, change "and" to --an--.

Column 6, Line 61, change "an" to --a--.

Column 6, Line 66, change "axially" to --axial--.

Column 6, Line 69, after "bore 107" insert --in--.

Column 7, Line 13, change "leg" to --arm--.

UNITED STATES PATENT AND TRADEMARK OFFICE

CERTIFICATE OF CORRECTION

PATENT NO. : 4,979,866

DATED : December 25, 1990

INVENTOR(S) : Maxwell Croy

It is certified that error appears in the above-identified patent and that said Letters Patent is hereby corrected as shown below:

Column 7, Line 22, change "clam" to --clamp--.

Column 8, Line 18, change "tho" to --to--.

Column 8, Line 19, change "holloW" to --hollow--.

Column 8, Line 19, delete "divided by interior 132".

Column 8, Line 24, change "side" second occurrence to --slide--.

Column 8, Line 58, change "so" to --some--.

Column 8, Line 67, delete "150".

Column 9, Line 19, change "yard" to --yards--.

Column 10, Line 23, after "viewed" delete semi-colon.

Column 11, Line 28, change "reduces" to --reduce--.

Column 11, Line 31, after "beneath" insert --the--.

Column 11, Line 43, after "cover" insert --the--.

Column 12, Line 30, change "extend" to --extends--.

Column 12, Line 58, after "most" insert --of--.

Column 13, Line 41, change "side" to --sides--.

Column 14, Line 22, after "in" insert --a--.

UNITED STATES PATENT AND TRADEMARK OFFICE

CERTIFICATE OF CORRECTION

PATENT NO. : 4,979,866

DATED : December 25, 1990

INVENTOR(S) : Maxwell Croy

It is certified that error appears in the above-identified patent and that said Letters Patent is hereby corrected as shown below:

Column 14, Line 46, change "yard" to --yards--.

Column 14, Line 62, change "side" to --sides--.

Column 15, Line 2, change "moveable" to --movable--.

Column 16, Line 6, change "forwardly extending" to --forwardly-extending--.

Column 17, Line 31, change "an" to --and--.

Column 17, Line 45, change "compacted" to --compactor--.

Column 17, Line 47, change "unit compacted unit body" to --compactor unit body--.

UNITED STATES PATENT AND TRADEMARK OFFICE

CERTIFICATE OF CORRECTION

PATENT NO. : 4,979,866

DATED : December 25, 1990

INVENTOR(S) : Maxwell Croy

It is certified that error appears in the above-identified patent and that said Letters Patent is hereby corrected as shown below:

Column 17, Line 57, after "from" insert --one--.

Column 18, Line 26, after "compacted" change the period to a comma.

Column 20, Line 17, after "is" insert --in--.

Signed and Sealed this

Seventh Day of July, 1992

*Attest:*

DOUGLAS B. COMER

*Attesting Officer*

*Acting Commissioner of Patents and Trademarks*